US006210139B1

(12) United States Patent
Ramanathan et al.

(10) Patent No.: US 6,210,139 B1
(45) Date of Patent: Apr. 3, 2001

(54) HIGH EFFICIENCY GEAR PUMP FOR PUMPING HIGHLY VISCOUS FLUIDS

(75) Inventors: Ravi Ramanathan, Midland; Robert E. Wrisley, Clare; Thomas J. Parsons, Freeland; Kun S. Hyun, Midland, all of MI (US)

(73) Assignee: The Dow Chemical Company, Midland, MI (US)

( * ) Notice: Subject to any disclaimer, the term of this patent is extended or adjusted under 35 U.S.C. 154(b) by 0 days.

(21) Appl. No.: 09/398,181

(22) Filed: Sep. 17, 1999

Related U.S. Application Data

(60) Provisional application No. 60/102,730, filed on Oct. 1, 1998.

(51) Int. Cl.[7] ..... F04C 2/16
(52) U.S. Cl. ..... 418/202; 418/206.4
(58) Field of Search ..... 418/201.1, 202, 418/206.1, 206.4

(56) References Cited

U.S. PATENT DOCUMENTS

| | | | | |
|---|---|---|---|---|
| 1,823,098 | * | 9/1931 | Hargis | 418/206.4 |
| 2,499,158 | * | 2/1950 | Perry | 418/169 |
| 2,531,726 | * | 11/1950 | Durdin, III | 418/206.4 |
| 2,831,435 | * | 4/1958 | Hobbs et al. | 418/206.4 |
| 3,837,768 | * | 9/1974 | Haupt | 418/206.5 |
| 3,888,607 | * | 6/1975 | Flaig | 418/206.4 |
| 4,032,391 | * | 6/1977 | Moked et al. | 159/47.1 |
| 4,492,544 | * | 1/1985 | Wolff | 418/107 |
| 4,737,087 | * | 4/1988 | Hertell | 418/102 |
| 5,145,349 | * | 9/1992 | McBurnett | 418/206.5 |
| 5,190,450 | * | 3/1993 | Ghosh et al. | 418/189 |
| 5,388,974 | * | 2/1995 | Streiff | 418/206.4 |
| 5,494,425 | * | 2/1996 | Stehr | 418/83 |
| 5,547,356 | * | 8/1996 | Stehr et al. | 418/206.1 |
| 5,618,172 | * | 4/1997 | Berger | 418/206.4 |

FOREIGN PATENT DOCUMENTS

| | | | | |
|---|---|---|---|---|
| 544927 | * | 2/1956 | (BE) | 418/206 |
| 719405 | * | 4/1942 | (DE) | 418/206 |
| 1553125 | * | 4/1970 | (DE) | 418/206 |

* cited by examiner

*Primary Examiner*—John J. Vrablik

(57) ABSTRACT

A gear pump exhibiting improved efficiency over a broader range of fluid viscosity and pump speed includes a compression zone defined between each of a pair of pump gears and internal walls of a gear chamber, wherein the compression zones have a non-uniform thickness along a longitudinal direction of the gears. The geometry of the compression zones provides a mechanism whereby the drag of the viscous fluid which is induced by the rotation of the pump gears carries the viscous fluid through a progressively narrower gap in the direction of rotation ending in a final smooth pinch-off at the start of the seal zone. The geometry of the compression zone maximizes the drag and pressurization of the viscous fluid being pumped into the teeth of the gears, thereby assisting in the complete filling of the teeth. The result is improved fill efficiency over a broader range of pump speeds and over a broader range of fluid viscosity.

3 Claims, 5 Drawing Sheets

10
12
14
16
18
20
22
23
24
25
26
27
II
110
112
114
116
118
120
122
123
124
125
126
127
128
129
IV
VII

HIGH EFFICIENCY GEAR PUMP FOR PUMPING HIGHLY VISCOUS FLUIDS

CROSS REFERENCE STATEMENT

This application claims the benefit of Provisional Application No. 60/102,730, filed Oct. 1, 1998.

FIELD OF THE INVENTION

This invention relates to apparatus for conveying highly viscous fluids and, more particularly, to gear pumps.

BACKGROUND OF THE INVENTION

Gear pumps are used for conveyance of highly viscous fluid, such as polymer melts. For example, gear pumps are typically used for conveying a viscous polymer melt from a vessel, such as a devolatilizer, to another unit operation, such as a pelletizer. In most cases, the highly viscous polymer melt enters the pump inlet under the influence of gravity with essentially no positive pressure. Known gear pumps are susceptible to a number of difficulties in their operation. In particular, for any given pump geometry, known gear pumps are extremely limited with respect to the range of viscosity of fluids that they can handle. Generally, as fluid viscosity increases, the throughput rate of the gear pump decreases, often resulting in a production bottleneck. Also, in general, as gear pump speed (RPM) increases, pump throughput initially increases, but eventually reaches a plateau level, wherein further increases in pump speed do not result in any significant increase in throughput and can lead to a production bottleneck. Heretofore it has generally not been possible to effectively overcome a production bottleneck of this type once the plateau level of the pump speed verses pump throughput has been reached without replacing the existing pump with a larger pump. However, the devolatilizer is typically specially configured to be coupled to a gear pump of a particular size, and it is not generally possible to switch to a larger capacity gear pump of conventional design without also replacing or significantly modifying the devolatilizer. Accordingly, it would be highly desirable to provide a gear pump which operates more efficiently to eliminate such production bottlenecks without requiring replacement or significant modification of the devolatilizer.

Various attempts have been made to design gear pumps which are capable of operating efficiently over a wider range of fluid viscosity and over a wider range of pump speeds. These efforts have focused primarily on pump geometry, particularly at the inlet side of the pump. However, the known pump designs have not been entirely satisfactory and further improvements are desirable.

SUMMARY OF THE INVENTION

The invention provides a gear pump having an improved geometry which attenuates the limitations relating to the viscosity of the fluid being pumped and the pump speed. More specifically, the gear chamber has been designed to provide compression zones which enable more fluid to be compressed over a longer path length into the teeth of the pump gears, and, therefore, provide higher production rates and higher fill efficiency. The improved geometry allows the gear pumps of this invention to operate more efficiently over a relatively broader range of pump speed and with a relatively broader range of fluid viscosity.

The gear pumps of this invention include a compression zone defined between each of a pair of pump gears and internal walls of a gear chamber, in which the compression zones have a non-uniform thickness, that is, the spacing between the teeth of the pump gears and the internal walls of the gear chamber in the vicinity of the compression zones varies along the length of the gears.

DESCRIPTION OF THE PRIOR ART

Figures 1, 2, 3, 4:
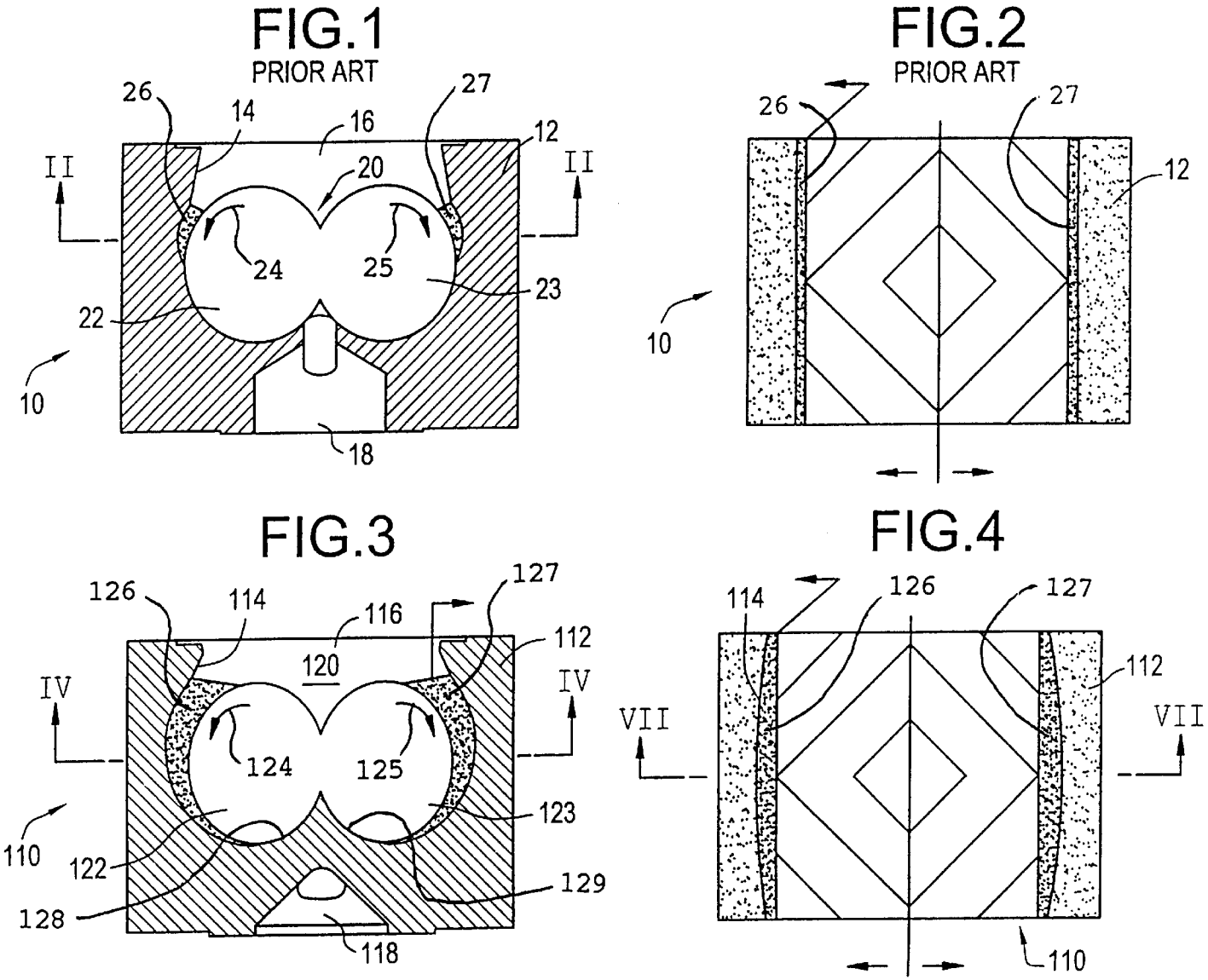
FIG.1 PRIOR ART
FIG.2 PRIOR ART
FIG. 1 is an elevational, cross-sectional, schematic representation of a prior art gear pump, the cross section being perpendicular to the rotational axes of the pump gears.
FIG. 2 is a cross-sectional, schematic representation of the pump shown in FIG. 1, the view being along line II—II of FIG. 1.
FIG. 3 is a cross-sectional, schematic representation of a gear pump according to the invention, the cross section being perpendicular to the axes of the pump gears.
FIG. 4 is a cross-sectional, schematic representation of the gear pump shown in FIG. 3, with the view being along lines IV—IV of FIG. 3.

A typical gear pump in accordance with the prior art is schematically illustrated in FIGS. 1 and 2. The prior art gear pump 10 includes a housing 12 defining internal walls 14. Gear pump 10 includes an inlet passage 16, an outlet passage 18, and a gear chamber 20 disposed between the inlet passage and the outlet passage. Pump gears 22, 23 are rotatably supported within gear chamber 20. The directions of rotation of pump gears 22, 23 are indicated by arrows 24, 25. Pump gears 22 and 23 have intermeshing teeth, such as herringbone style teeth. Compression zones 26, 27 are defined between pump gears 22, 23 and internal wall 14 of gear chamber 20. Compression zones 26 and 27 have a maximum thickness adjacent inlet passage 16. The thickness of compression zones 26, 27 decrease in the direction of outlet passage 18, and reach a minimum thickness at about a location on a plane defined by the parallel axes of pump gears 22, 23. The thickness of a compression zone refers to the distance from the outer surfaces of the teeth of the pump gears to the nearest surface of the internal walls of the gear chamber.

As can be seen by reference to FIG. 2, the thickness of compression zones 26, 27 does not vary along a direction parallel with the rotational axes of pump gears 22, 23.

DESCRIPTION OF THE PREFERRED EMBODIMENTS

A gear pump having a design in accordance with the principles of this invention is shown in FIGS. 3 through 4. Gear pump 110 includes a housing 112, having internal walls 114 defining an inlet passage 116, an outlet passage 118, and a gear chamber 120 disposed between inlet passage 116 and outlet passage 118. Pump gears 122, 123 are rotatably supported within gear chamber 120. Pump gears 122, 123 include intermeshing teeth, which, in the case of the embodiment shown in FIGS. 3–8, are herringbone style teeth. The direction of rotation of pump gears 122, 123 are indicated by arrows 124, 125. Gear chamber 120 is generally divided into two compression zones 126, 127 and two seal zones 128, 129. Compression zones 126, 127 are defined as those portions of the internal volume of gear chamber 120 which are disposed between the teeth of gears 122, 123 and the internal walls of gear chamber 120, and which are located above seal zones 128, 129. Seal zones 128, 129 refers to that portion of the internal volume of gear chamber 120 in which the clearance between the teeth of the gears 122, 123 is so small as to effectively prevent any significant fluid movement through the space between the teeth of gears 122, 123 and the internal walls of gear chamber 120, thereby providing an effective seal against the flow of fluid past the outer surfaces of the teeth of gears 122, 123. Each of the compression zones 126, 127 has a non-uniform thickness. The thickness of each of the compression zones 126, 127, which is the distance from the outer surfaces of the teeth of gears 122, 123 to the surface of the internal walls of the gear chamber, is greatest at a location adjacent inlet passage 116. The thickness of each of the compression zones 126, 127 continuously decreases from inlet passage 116 toward outlet passage 118. Preferably, the thickness of the compression zones 126, 127 smoothly decrease from inlet passage 116 toward outlet passage 118. The expression "smoothly decrease" as used herein means that internal walls 114 defining compression zones 126, 127 do not have any abrupt or sharp edges defined by intersecting planes, but instead are continuously curved.

As can be seen by reference to FIG. 4, compression zones 126, 127 have a non-uniform thickness along the longitudinal direction of gears 122, 123, which is greatest at a location centered between axially opposite ends of pump gears 122, 123 and which is smallest at locations adjacent each of the ends of pump gears 122, 123. Preferably, the thickness of the compression zones continuously decreases from the location centered between the opposite ends of pump gears 122, 123 toward each of the ends of pump gears 122, 123. Further, it is desirable that the thickness of the compression zones 126, 127 continuously and smoothly decrease from the location centered between the opposite ends of gear pumps 122, 123 toward each of the ends of gear pumps 122, 123.

Compression zones 126, 127 and seal zones 128, 129 are preferably further defined by the following criteria: the area of the compression zone is maximized subject to the constraint that the areas of the seal zones 126, 127 be sufficient to maintain a reliable seal between the teeth of gears 122, 123 and the internal walls of gear chamber 120. Maximizing the surface area of the compression zone maximizes filling of the volume bounded by adjacent teeth and the internal walls of the gear chamber 120 at the areas of seal zones 126, 127, which, in turn, results in greatly improved pump efficiency. This means that higher flow rates can be achieved for a given size gear pump. Higher pump efficiency for a given size pump will result in substantial capital savings, as it will not be necessary to replace or substantially modify as associated equipment, such as a devolatilizer, in order to accommodate a larger size pump. The option of replacing a conventional gear pump with an improved gear pump which is, in accordance with the principles of this invention, capable of achieving greater fill efficiency and higher throughput rates for a given size pump, will also result in reduced labor costs relating to modification or replacement of equipment associated with a particular size pump, and a reduced period during which a production unit is taken out of service.

Illustrated gear pump 110 can be described as having a double compression zone wherein the fluid being pumped is compressed in both the direction of rotation of pump gears 122, 123 and in the direction parallel to the rotational axes of pump gears 122, 123. The geometry of the double compression zones 126, 127 provide a mechanism whereby the fluid is induced by rotation of pump gears 122, 123 through a progressively narrowing gap which generates increasing pressure in the direction of rotation of gears 122, 123 ending in a final smooth pinch-off at the start of seal zones 128, 129. A key difference between the invention and the prior art is that the continuous and smooth variation of the boundary of the compression zone in both the axial and radial direction provides more time to fill the space between teeth and, thus, enables more fluid to be compressed over a longer path length into the teeth of pump gears 122, 123, thus providing for higher product rates and higher fill efficiency.

Figure 7:
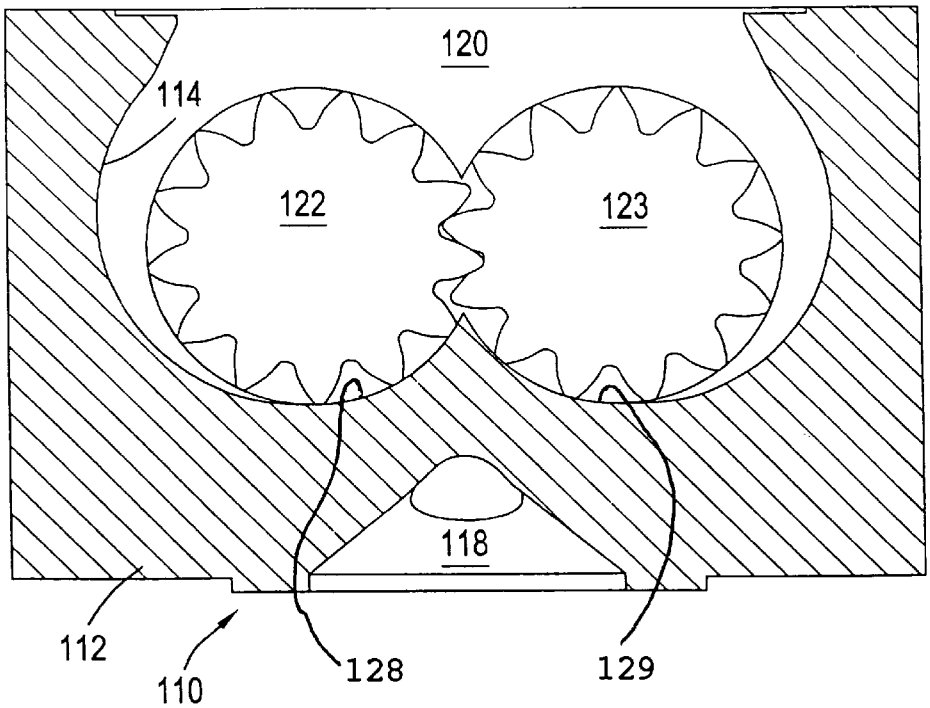
FIG. 7 is an elevational, cross-section of the pump shown in FIGS. 3–6 with the pump gears in place, as seen along view lines VII—VII of FIG. 4.

As previously mentioned, an important constraint on the area of compression zones 126, 127 is that a reliable seal must be maintained between the teeth of gears 122, 123 and internal walls of gear chamber 120. This generally means that seal zones 128, 129 must be sized, shaped and contoured so that the entire length of at least one tooth of each of gears 122, 123 is sufficiently closely spaced to its associated seal zone to maintain an effective seal between the compression zone and the pump discharge. However, as illustrated in FIG. 7, it is generally preferred to size, shape and contour seal zones 128, 129 so that at least two adjacent teeth on each of gears 122, 123 are sufficiently closely spaced to their respective seal zones to maintain an effective seal (that is, one in which very little, if any, fluid can flow between the teeth and the walls of the gear chamber in the area of the seal zones) along the entire length of two adjacent teeth. This will prevent minor damage, such as from excessive wear or abrasion, to any single tooth from significantly affecting overall pump performance, thus ensuring longer, reliable service life without significantly reducing pump efficiency and throughput.

Figure 5:
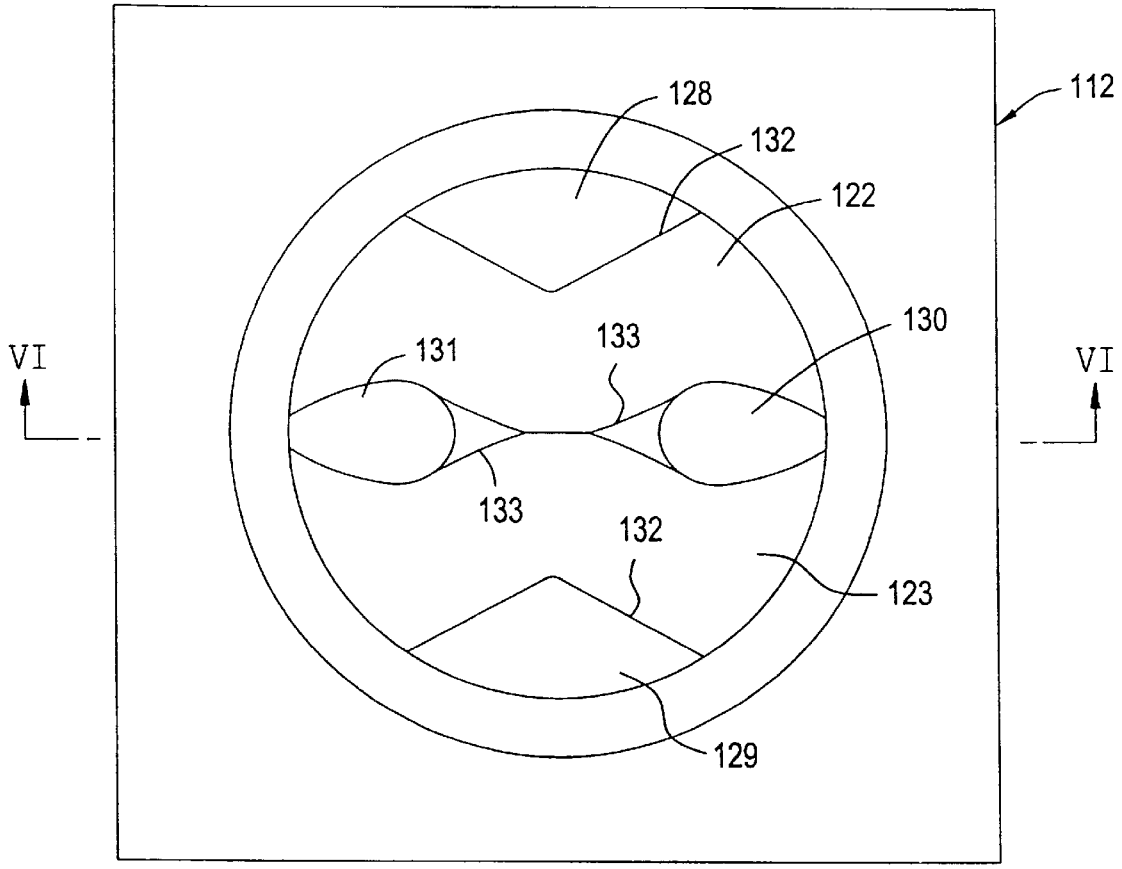
FIG. 5 is a top plan view of the gear pump shown in FIG. 3 with the pump gears and inlet side of the pump removed.
Figure 8:
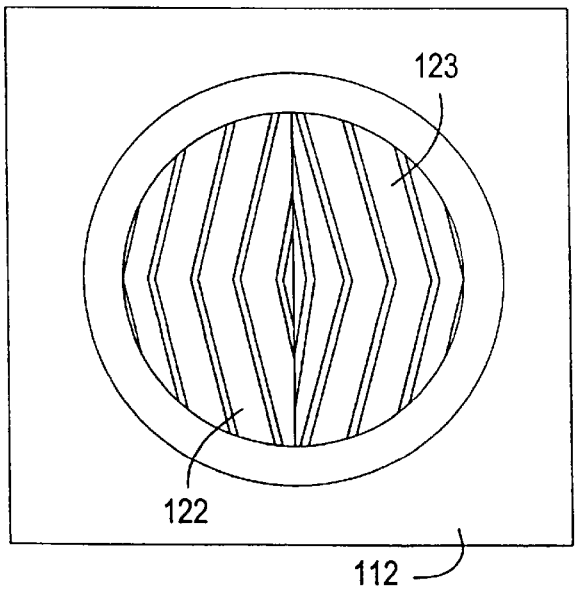
FIG. 8 is a top plan view of the pump shown in FIGS. 3–7 with herringbone pump gears in place and with the inlet side of the pump removed.

Because seal zones 128, 129 are shaped to follow the length of at least one tooth and preferably two adjacent teeth of gears 122, 123, the shape of seal zones 128, 129 is determined by the tooth pattern of gears 122, 123. In the case of herringbone gears, the teeth wind around the gears 122, 123 in a helical path in a first direction (for example, in a clockwise direction) from a first end of the gears to the lengthwise mid-section of the gear and then take a sharp turn and wind around the gear in a helical path in a direction opposite to the first direction (for example, in a counter-clockwise direction) from the lengthwise mid-section of the gear to a second end of the gear opposite the first end, as shown in FIG. 8. Thus, in the case of pump 110, which has a double tunnel discharge with two discharge ports 130, 131 (FIGS. 5 and 6) and which has herringbone gears 122, 123, maximization of the area of the compression zone while maintaining an effective seal between at least two teeth and the portion of the internal walls of gear chamber 120 defining seal zones 128, 129 results in a V-shaped seal zone as indicated in FIG. 5 by seal zone boundaries 132, 133. It should be noted that the seal zone boundaries 132, 133 are shown for purposes of illustration only, as there is a smooth transition from the compression zone to the seal zone which would not be readily visible, if at all.

Figure 6:
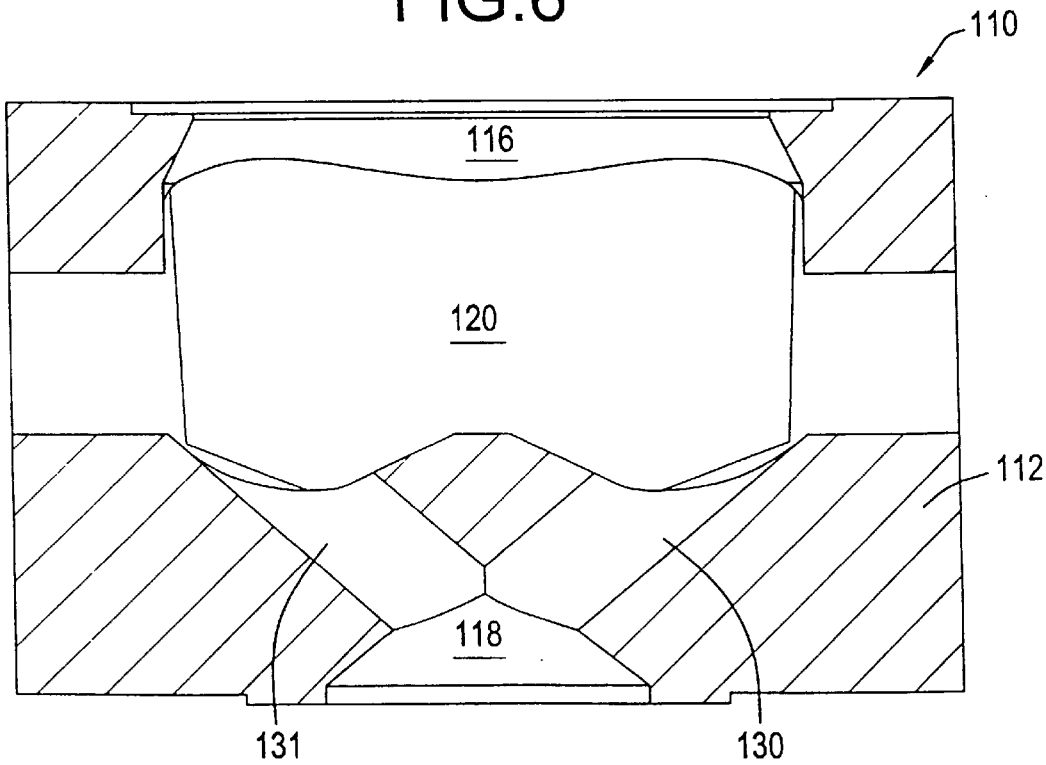
FIG. 6 is an elevational, cross-section of the gear pump shown in FIGS. 3–5 with the pump gears removed, as seen along view lines VI—VI of FIG. 5.

A double tunnel discharge (as shown in FIGS. 5 and 6) is preferred because it provides a larger area for the compression zone on the suction side of pump 110 without violating the requirement that at least one tooth, and more preferably two teeth, of each of gears 122, 123 will seal against the portion of the gear chamber walls defining the seal zone. The double tunnel discharge also allows a larger angle of rotation of gears 122, 123 before the teeth break the seal.

Figure 11:
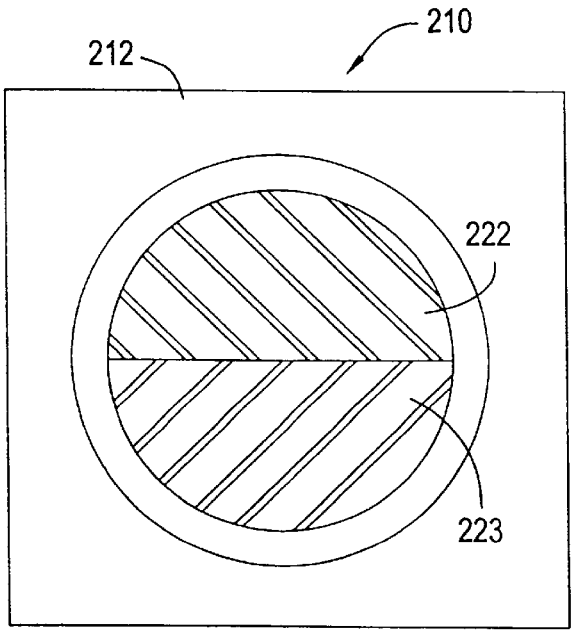
FIG. 11 is a top plan view of the pump shown in FIGS. 9 and 10 with the gears in place and with the inlet side of the pump removed.
Figure 9:
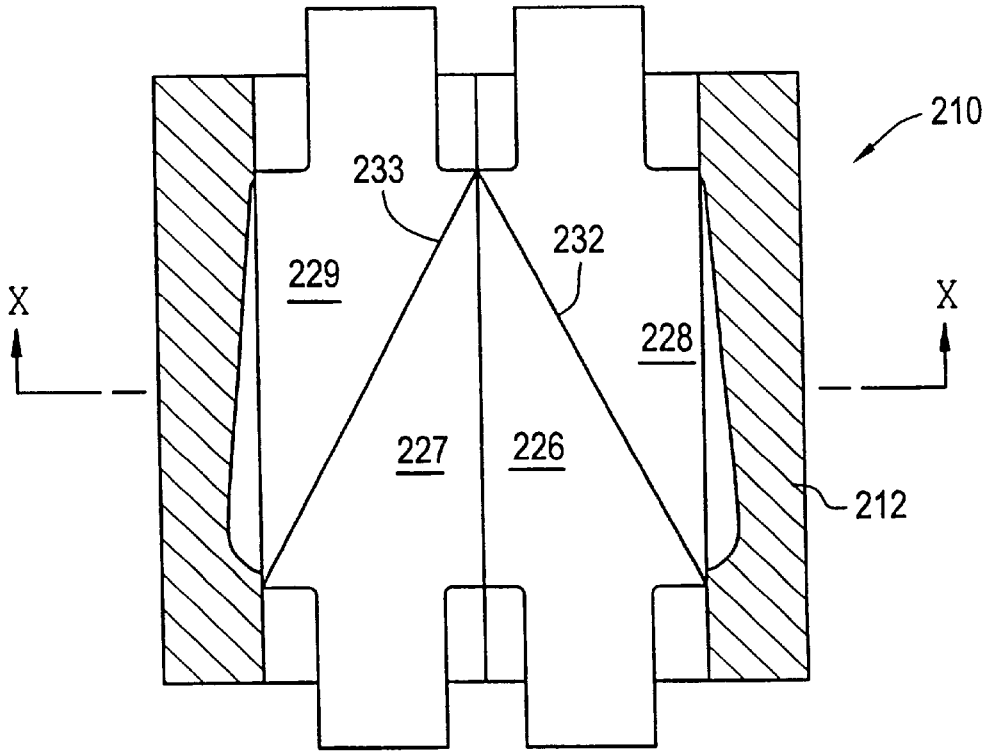
FIG. 9 is a top plan view of an alternative embodiment of the invention configured for use with helical gears, with the inlet side of the pump and the gears removed.
Figure 10:
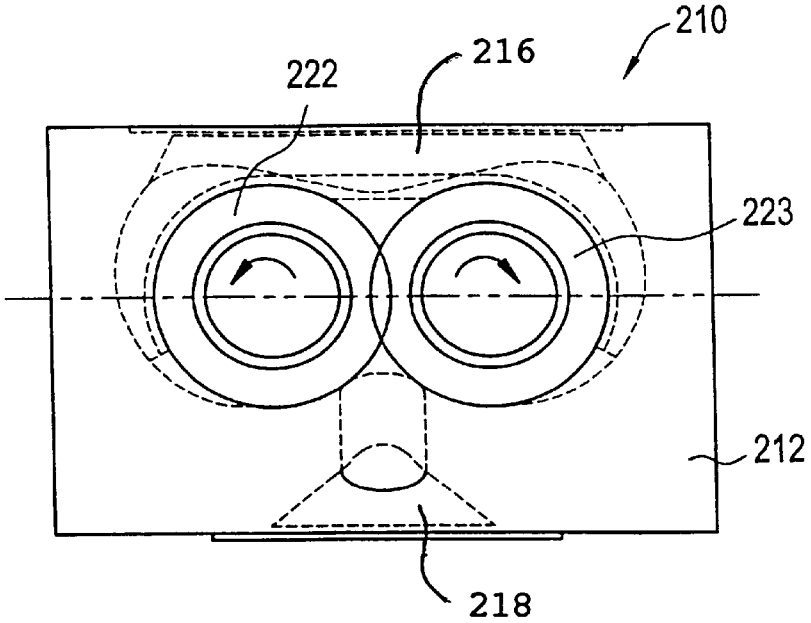
FIG. 10 is an elevational, cross-sectional view of the pump shown in FIG. 9 with the gears and inlet side of the pump in place as seen along view lines X—X of FIG. 9.

In FIGS. 9 through 11, an alternative embodiment of the invention utilizing helical gears is shown. As with gear pump 110, gear pump 210 includes a housing 212 defining internal walls 214, inlet passage 216, outlet passage 218 and gear chamber 220 disposed between the inlet passage and the outlet pump. Gears 222, 223 are rotatably supported within gear chamber 220. Gears 222, 223 have intermeshing teeth which are helically wound around the entire length of gears 222, 223. As with pump 110, compression zones 226, 227 and seal zones 228, 229 are defined by the principle of providing a double compression zone wherein the fluid is compressed in both the direction of rotation of gears 222, 223 and in the direction parallel to the rotational axes of pump gears 222, 223, and compression zones 226, 227 provide a mechanism whereby the fluid is induced by rotation of gears 222, 223 through a progressively narrowing gap in the direction of rotation to generate increasing pressure until the fluid reaches smooth pinch-off at the start of seal zones 228, 229. Applying the same principles to pump 210 as pump 110, the thickness of each of the compression zones 226, 227 continuously decreases from inlet passage 216 toward outlet passage 118, and each of the compression zones has a non-uniform thickness along the longitudinal (axial) direction of gears 222, 223. However, as can be seen by reference to FIG. 9, the thickness of the compression zone is greatest at a point near one end of each of gears 222, 223, and continuously decreases toward the opposite end. This modification is provided to adapt the principle of this invention to a pump 210 having helical gears 222, 223 rather herringbone gears. Likewise, seal zone 228, 229 and compression zones 226, 227 are defined by seal zone boundaries 232, 233, which follow the contour of the helical teeth of gears 222, 223. Accordingly, seal zones 228, 229 are approximately triangular in shape.

Figure 12:
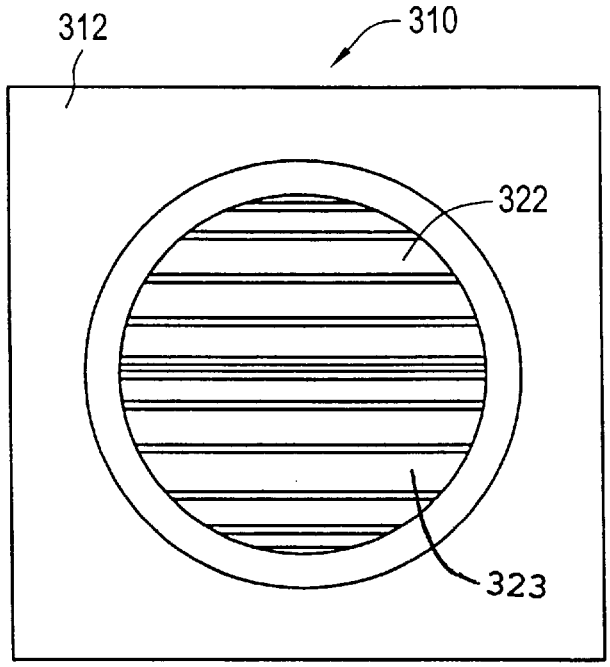
FIG. 12 is a top plan view of a second alternative embodiment of the invention which utilizes spur gears, with the inlet side of the pump removed and with the spur gears in place.
Figure 13:
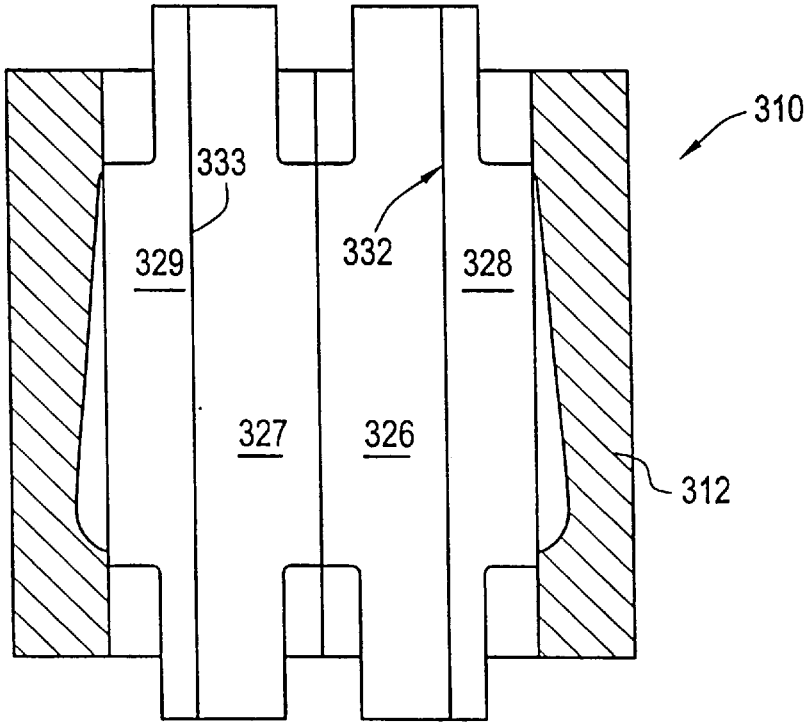
FIG. 13 is a top plan view of the pump shown in FIG. 12 with the inlet side of the pump and the spur gears removed.

The principles of this invention can also be applied to gear pump 310 (FIGS. 12 and 13), which utilizes spur gears 322, 323 having teeth which extend along straight lines parallel with the axial directions of gears 322, 323 as shown in FIG. 12. Pump 310 is similar to pump 110 with respect to the shape of housing 312, with the primary difference being that seal zones 332, 333 and compression zones 326, 327 are defined by seal zone boundary lines 332, 333, which are straight lines which are parallel with the rotational axis of gears 322, 323 to maximize the area of compression zones 326, 327 while maintaining a seal between at least one tooth, and more preferably two teeth of each gear 322, 323 and the internal walls of housing 312 in the area of seal zone 328, 329.

The invention has been tested in the laboratory and evaluated in the manufacture of polystyrene for a given material and a given pressure differential (between the pump inlet and outlet) fill. Efficiency (ratio of the volume of product pumped to base volume of pump defined by tooth volume) as a function of pump speed (RPM) was shown to remain relatively high (greater than 85 percent) over a broader range of pump speed as compared with conventional gear pumps.

It will be apparent to those skilled in the art that various modifications to the preferred embodiment of the invention as described herein can be made without departing from the spirit or scope of the invention as defined by the appended claims.

What is claimed is:

1. A gear pump comprising:

a housing having internal walls defining an inlet passage, an outlet passage, and a gear chamber disposed between the inlet passage and the outlet passage;

first and second pump gears rotatably supported within the gear chamber, the first and second pump gears having intermeshing teeth; and a compression zone defined between each of the pump gears and the internal walls of the gear chamber, each of the compression zones having a thickness along a longitudinal direction of the pump gears that continuously decreases from the location centered between the axially opposite ends of the pump gears toward each of the ends of the pump gears when the pump is at rest, the thickness of each of the compression zones being greatest at a location adjacent the inlet passage and continuously decreasing toward the outlet passage.

2. The pump of claim 1, wherein the thickness of the compression zones continuously and smooth decreases from the location centered between the axially opposite ends of the pump gears toward each of the ends of the pump gears.

3. The pump of claim 2, wherein the thickness of the compression zones smoothly decreases from the inlet passage to the outlet passage.

* * * * *